US005570928A

United States Patent [19]

Staunton et al.

[11] Patent Number: 5,570,928

[45] Date of Patent: Nov. 5, 1996

[54] JOINED CONCERTINA CHAIRS

[75] Inventors: Bryan F. Staunton, Slacks Creek; Rick J. Maynard, Shailer Park, both of Australia

[73] Assignee: Bermere Pty. Ltd., Queensland, Australia

[21] Appl. No.: 414,860

[22] Filed: Mar. 31, 1995

[30] Foreign Application Priority Data

Apr. 5, 1994 [AU] Australia ..... PM4808

[51] Int. Cl.[6] ..... A47C 15/00

[52] U.S. Cl. ..... 297/232; 297/44; 297/45

[58] Field of Search ..... 297/232, 44, 45, 297/248, 16.1

[56] References Cited

U.S. PATENT DOCUMENTS

| | | | |
|---|---|---|---|
| 1,738,473 | 12/1929 | Green | 297/232 |
| 2,053,659 | 9/1936 | Gisser | 108/91 X |
| 2,460,459 | 2/1949 | Kraska | 297/44 X |
| 2,914,111 | 11/1959 | Mize | 297/45 |
| 2,920,687 | 1/1960 | Hurley | 297/232 X |
| 2,930,429 | 3/1960 | Mize | 297/45 |
| 3,050,050 | 8/1962 | Kubicek | 297/44 X |
| 3,640,568 | 2/1972 | Suzuki et al. | 297/232 |
| 4,105,244 | 8/1978 | Colby | 297/45 |
| 4,826,241 | 5/1989 | Barras | 297/45 X |

FOREIGN PATENT DOCUMENTS

| | | | |
|---|---|---|---|
| 535802 | 1/1922 | France | 297/45 |
| 3227119 | 2/1983 | Germany | 297/232 |
| 336060 | 10/1930 | United Kingdom | 297/45 |
| 403387 | 12/1933 | United Kingdom | 297/45 |
| 675100 | 7/1952 | United Kingdom | 297/45 |
| 681490 | 10/1952 | United Kingdom | 297/45 |

*Primary Examiner*—Peter M. Cuomo
*Assistant Examiner*—Rodney B. White
*Attorney, Agent, or Firm*—Panitch Schwarze Jacobs & Nadel, P.C.

[57] ABSTRACT

A multiple folding chair arrangement particularly concerned with 2, 3, 4, 5 and 6 chair multiples and comprising three or more rigid vertical support frames defining the sides of two or more chairs and having front and rear edges, two pairs of diagonally crossed members located, respectively, between the front and rear edge regions of each frame, each one of the pair of members being pivotally connected adjacent a lower end to a separate one of an adjacent frame and being pivotally joined to the other member at or near its midpoint, the upper ends of said two pairs of members defining a plane for a seat when the chair arrangement is in an erected seating configuration, and a brace pivotally connected adjacent to the upper ends of each member and pivotally connected to the adjacent support frame, the arrangement including hand grips associated with the upper end of one or more of each pair of members located at the rear of the chairs to enable the chairs to be folded whereby the frames are brought together into close proximity when the hand grips are gripped and raised.

8 Claims, 2 Drawing Sheets

JOINED CONCERTINA CHAIRS

BACKGROUND OF THE INVENTION

This invention relates to folding chairs and is particularly concerned with multiple folding chair arrangements.

DESCRIPTION OF THE PRIOR ART

There are numerous designs of folding chairs in the market place but as far as the inventors are aware, there are no designs for folding a collection of chairs joined together for transportation purposes. The nearest design to this concept is the theatre chair but in this design it is usually only the seat portion which folds up while the overall length of the combination remains constant. Such arrangements are consequently not generally suited to transportation from venue to venue and for this reason they are used in one location and fixed to the floor.

The problem with individual folding chairs is that they are awkward to carry en masse and they still occupy a relatively large space. This problem has been addressed to a certain extent by the use of stackable chairs, however, the design characteristics enabling stacking significantly limits the aesthetic features of the chairs and they still take up considerable storage/transportation space.

OBJECT OF THE INVENTION

It is therefore an object of the present invention to provide a multiple folding chair arrangement which obviates or minimises these problems, or at least provides the public with a useful alternative.

SUMMARY OF THE INVENTION

According to the present invention, there is provided a multiple folding chair arrangement comprising three or more rigid vertical support frames defining the sides of two or more chairs and having front and rear edges, two pairs of diagonally crossed members located, respectively, between the front and rear edge regions of each frame, each one of the pair of members being pivotally connected adjacent a lower end to a separate one of an adjacent frame and being pivotally joined to the other member at or near its midpoint, the upper ends of said two pairs of members defining a plane for a seat when the chair arrangement is in an erected seating configuration, and a linkage assembly pivotally connected adjacent to the said upper ends of each member and pivotally connected to the adjacent support frame, the arrangement including means associated with the upper end of one or more of each pair of members located at the rear of the chairs to enable the chairs to be folded whereby the frames are brought together into close proximity when such means are gripped and raised.

DETAILED DESCRIPTION OF THE INVENTION

Because the frames of the chair arrangement are brought close together upon folding, the volume occupied by the folded arrangement is essentially equivalent to the dimensions of the support frames. Further, in the case where back supports are provided on each chair, these can be constructed from tubular or solid members projecting from the frame with a cloth insert so that the volume of these portions is also minimal.

The rigid vertical support frames can comprise a planar member or an open structure of tubular or similar componentry. The latter of these is preferred as it lends itself to the use of lightweight materials such as tubular aluminium or stainless steel. These are, in fact, the preferred materials for the entire construction of the chair, except of course, for the seat and backrest which are preferably of woven or sheet plastics material fabrication. Other construction materials can, nevertheless, be used as will be apparent to the skilled addressee. The most ulitarian of these other materials will be injection molded plastics such as polyvinylchloride and h.d polypropylene. Composite materials such as kevlar® and the like are also of particular utility.

Preferably, square tube aluminium is used to construct the frames, arm rests (when present), and back supports (when present), and solid aluminium rod to construct the diagonally crossed members and the braces. Plastic or metal inserts may be used to seal the ends of the tubes.

An open structured frame will suitably have a substantially rectangular configuration with an armrest defining the upper portion and a connecting bar extending at a spaced location between vertical uprights in the lower portion.

The diagonally crossed members will suitably be spaced apart from one another by a cylindrical spacer element to enable respective connection to the inside or outside upright of the open structured frame. The top ends of the members on the front of the chair arrangement are preferably rigidly connected by a respective rigid rod or the like to the respective top ends of a similar pair of members on the rear of the chair. Such rods act as a base to which a seat is connected. The seat must be sufficiently flexible to enable folding between its ends or, if rigid, have appropriate hinge or like pivoting portions to achieve this. Preferably, the seat is of fabric construction and is connected to the connecting rod by rivets, studs, domes or the like.

The linkage assemblies which connect the upper ends of the diagonally crossed members to the support frames are suitably designed to be of a non-rigid construction. To this end they can be manufactured from a flexible material such as a woven or plastics fabric or, more preferably, from inter-linked rigid components which can pivot relative to one another. Most suitably each linkage assemblies comprises two substantially equal length rigid elements which are pivotally connected to one another and to the adjacent frame and cross-member.

The means to enable the chairs to be readily folded suitably comprise grips projecting rearwardly of the frame members on one or more of each pair of frame members. Preferably, in the case of two seats, a single grip is located on the outside of each seat. In the case of three seats, a single grip is located on the outside of the outer seats and two grips are located on the inner seat. For four seat arrangements, a single grip is located on the outside of each seat when viewed from a symmetrical perspective, and this is essentially the same for a five seater arrangement with the middle seat including two grips. These grips are preferably formed integrally and rigidly with the frame members on the outer pairs of chair frames.

The chair arrangement according to the invention may be formed with any number of seats, within the limits of practical considerations. The most manageable number is from 2 to 6 with four being the most preferred.

A preferred embodiment of the invention will now be described with reference to the accompanying drawings.

DESCRIPTION OF THE PREFERRED EMBODIMENT

Figure 1:
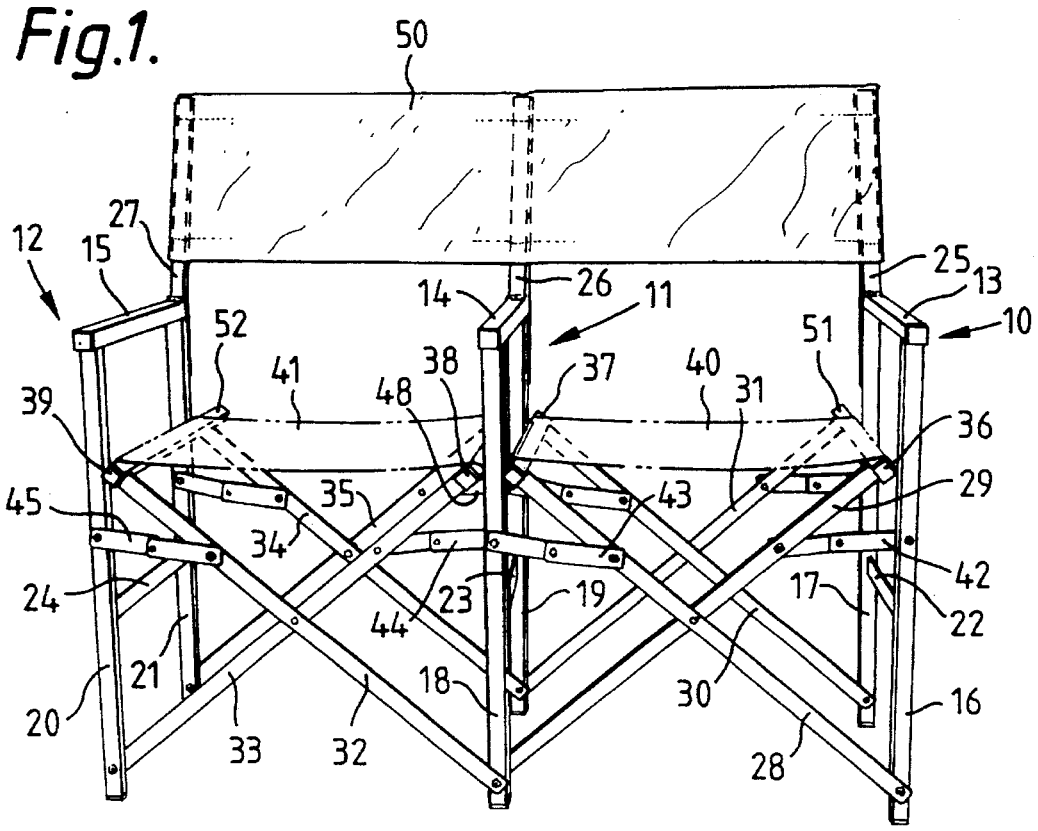
FIG. 1 is a front perspective of a twin chair arrangement according to one aspect of the present invention.

In all the drawings, like reference numerals refer to like parts.

The twin chair arrangement depicted in the drawings comprises three rigid vertical support frames 10, 11, 12 of substantially rectangular configuration. The frames are fabricated from aluminium and comprise square tubular arms 13, 14, 15, uprights 16, 17, 18, 19, 20, 21, strengthening struts 22, 23, 24 formed from aluminium bar, and back-rest extensions 25, 26, 27 on which a commercial strength plastic fabric backrest 50 is fitted.

Extending between adjacent frames are sets of diagonally crossed members 28, 29, 30, 31, 32, 33, 34, 35. These members are fabricated from aluminium bar and are pivoted in pairs about their midpoints. Spaces in the form of small cylinders separate each member of a pair from the other. The members are pivotally connected at their lower ends to a respective upright.

The pairs of diagonally crossed members between any two supports are connected at their upper ends by connecting rods 36, 37, 38, 39. These connecting rods define a plane for the respective seats 40, 41 and consist of square profile aluminium tubes which have been welded to the members. The seats are manufactured from commercial strength plastic fabric and are riveted to the connecting rods.

Extending between the upper end regions of the front diagonally crossed members and the adjacent respective uprights of the support frames are linkage assemblies 42, 43, 44, 45. Similar linkage assemblies are located on the rear side of the chair arrangement. These linkage assemblies each comprise two equal length aluminium bars pivotally connected to one another and pivotally connected to the diagonally crossed members and the uprights.

Figure 4:
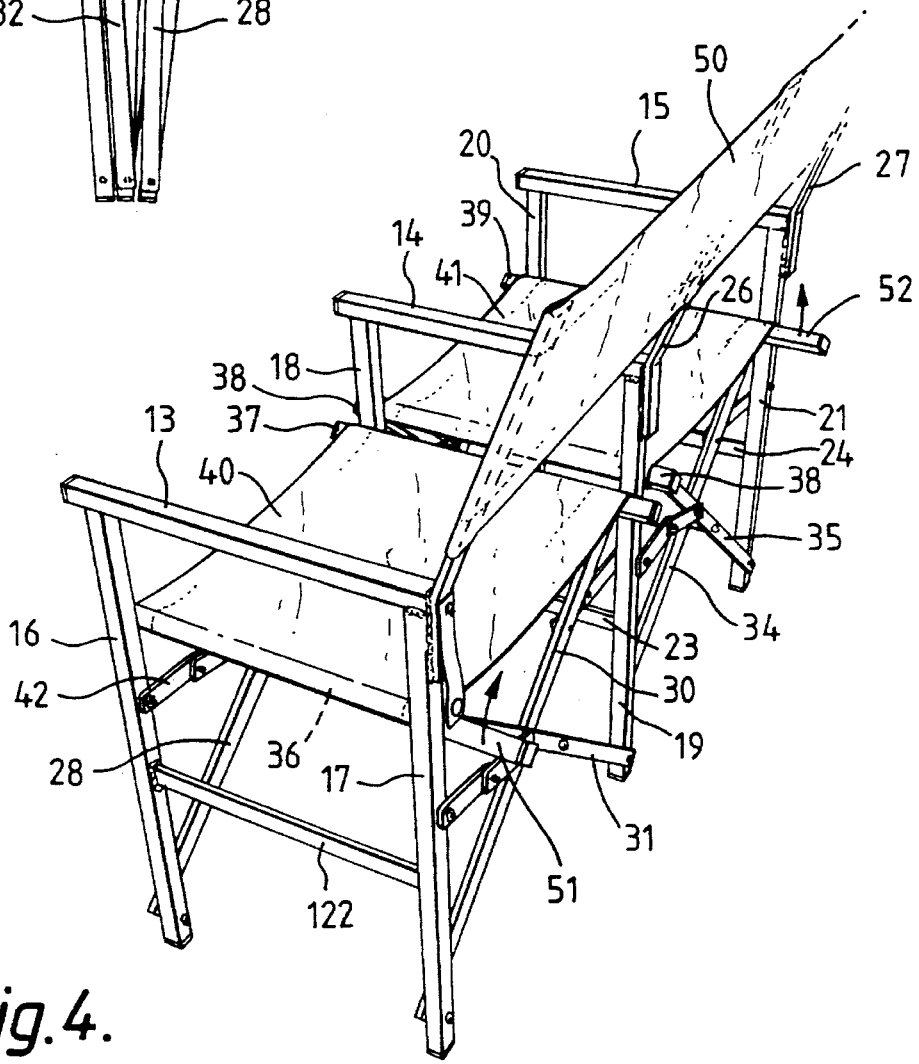
FIG. 4 is a rear perspective of a portion of FIG. 1 showing the grip means.

Grips are formed on the rear side of the twin chair arrangements as depicted in FIG. 4. These grips 51, 52 comprise extensions of the connecting rods 36, 39 and are of such a size as to enable ready gripping by hand.

Figure 2:
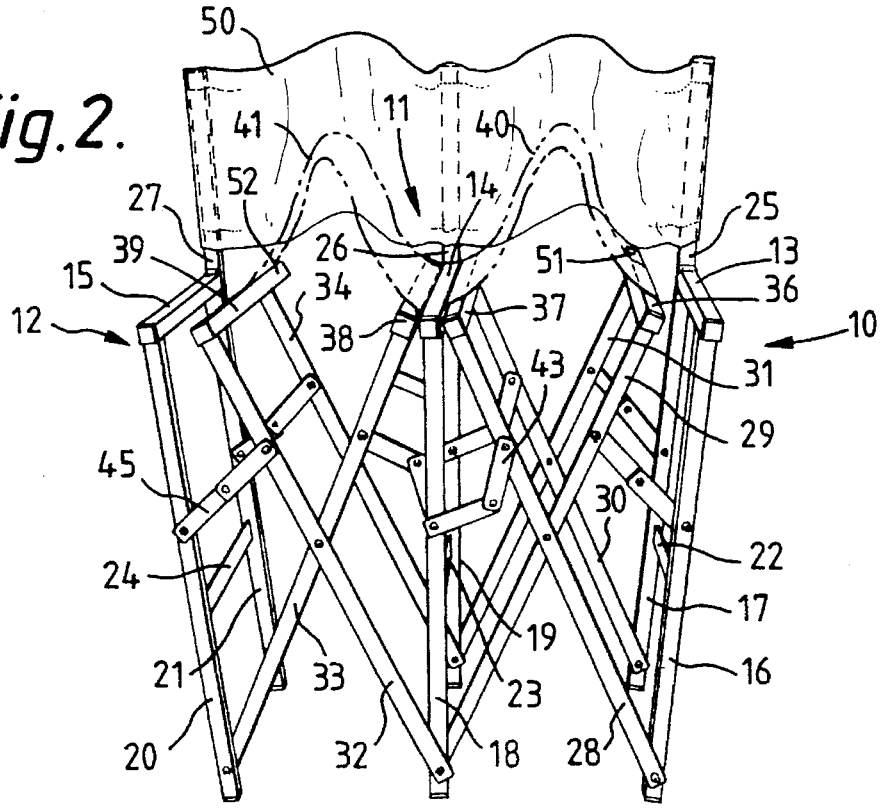
FIG. 2 is a front perspective of the twin chair arrangement depicted in FIG. 1 in a partially collapsed form.

In order to fold the chair arrangement depicted in FIG. 1, the grips 51, 52 are taken in each hand and lifted. This brings the outer support frames 10, 12 inward toward the central support frame 11, as depicted in FIG. 2, while the diagonally crossed members incline relative to one another at an increasingly steeper angle. Simultaneously the chair back 50 folds as do the respective seats 40, 41.

Figure 3:
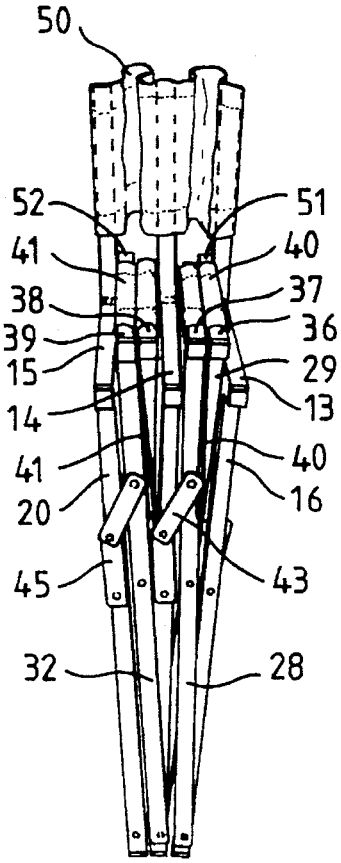
FIG. 3 is a front perspective of the twin chair arrangement depicted in FIG. 1 in a fully collapsed form.

Continued lifting of the grips eventually results in the fully folded configuration depicted in FIG. 3. Such a configuration may be maintained by a strap or belt connecting the rear uprights.

The folded chair arrangement is very easy to lift and stow and takes up very little space.

In order to unfold the chair it is simply a matter of undoing the strap or belt, if present, and pulling one of the outer armrests in a horizontal direction. By virtue of the construction and linkage assemblies, this results in an immediate rigid and safe seating arrangement.

The invention thus described overcomes all of the problems of prior art collapsible seating arrangements and provides the public with a useful and convenient form of multiple seating.

Whilst the above has been given by way of illustrative example of the invention, many modifications and variations may be made thereto by persons skilled in the art without departing from the broad scope and ambit of the invention as herein set forth.

We claim:

1. A multiple folding chair arrangement comprising three or more rigid vertical support frames defining sides of two or more chairs and having front and rear edge regions, two pairs of diagonally crossed members located, respectively, between the front and rear edge regions of each frame, each one of the pair of members being pivotally connected adjacent a lower end to a separate one of an adjacent support frame and being pivotally joined to the other member at its midpoint, the two pairs of members having upper ends which define a plane for a seat when the chair arrangement is in an erected seating configuration, and a non-rigid linkage assembly pivotally connected adjacent to the upper ends of each member and pivotally connected to an adjacent support frame, each linkage assembly comprising two substantially equal length rigid elements which are pivotally connected to one another, the arrangement including means associated with the upper end of one or more of each pair of members located at the rear edge region of the chairs to enable the chairs to be folded whereby the frames are brought together into close proximity when such means are gripped and raised.

2. A multiple folding chair arrangement as claimed in claim 1, wherein each rigid vertical support frame comprises a substantially rectangular open structure of predominantly tubular componentry.

3. A multiple folding chair arrangement as claimed in claim 1, wherein the chairs include backrests fabricated from flexible material and seats also fabricated from flexible material extending between the upper ends of the diagonally crossed members.

4. A multiple folding chair arrangement as claimed in claim 1, wherein each diagonally crossed member in the front region of the frame is joined by a connecting member to a respective diagonally crossed member on the rear edge region of the frame.

5. A multiple folding chair arrangement as claimed in claim 4, wherein the means to enable folding of the chair arrangement comprises hand grips extending rearwardly from one or more of each pair of connecting members beyond the outer support frames.

6. A multiple folding chair arrangement as claimed in claim 1, wherein there are three rigid vertical support frames defining sides of two chairs.

7. A multiple folding chair arrangement as claimed in claim 1, wherein there are four rigid vertical support frames defining sides of three chairs.

8. A multiple folding chair arrangement as claimed in claim 1, wherein there are five rigid vertical support frames defining sides of four chairs.

* * * * *